United States Patent [19]

Polgar

[11] Patent Number: 4,881,054

[45] Date of Patent: Nov. 14, 1989

[54] RELAY DRIVE FOR POLARIZED RELAY

[75] Inventor: Tibor Polgar, Maria Enzersdorf, Austria

[73] Assignee: Schrack Elektronik-Aktiengesellschaft, Vienna, Austria

[21] Appl. No.: 236,920

[22] Filed: Aug. 26, 1988

[30] Foreign Application Priority Data

Aug. 27, 1987 [AT] Austria ..... 2164/87

[51] Int. Cl.[4] ..... H01F 7/08

[52] U.S. Cl. ..... 335/230; 335/234

[58] Field of Search ..... 335/229, 230, 234

[56] References Cited

U.S. PATENT DOCUMENTS

| | | | |
|---|---|---|---|
| 4,727,344 | 2/1988 | Koga et al. | 335/229 X |
| 4,730,175 | 3/1988 | Ichikawa et al. | 335/230 |
| 4,730,176 | 3/1988 | Matsuo et al. | 335/230 |

FOREIGN PATENT DOCUMENTS

| | | |
|---|---|---|
| 0130423 | 1/1985 | European Pat. Off. . |
| 0157029 | 10/1985 | European Pat. Off. . |
| 1439210 | 1/1969 | Fed. Rep. of Germany . |
| 2128557 | 6/1972 | Fed. Rep. of Germany . |
| 73359 | 5/1970 | German Democratic Rep. . |
| 56-36109 | 4/1981 | Japan . |

*Primary Examiner*—George Harris

*Attorney, Agent, or Firm*—Cushman, Darby & Cushman

[57] ABSTRACT

Relay drive for a polarized relay having an armature that can be moved in at least one working air gap provided between two pole faces of a split yoke and at least one permanent magnet, as well as a coil permeated with parts of the yoke, or a core directly connected therewith, wherein at least one pole face cooperating with the armature or located thereon is formed from one pole face of the permanent magnet and another pole face cooperating with the armature or disposed thereon is formed either by a pole face of another permanent magnet or of a soft-iron part, said soft-iron part being interchangeable with a permanent magnet of the same size.

14 Claims, 3 Drawing Sheets

RELAY DRIVE FOR POLARIZED RELAY

BACKGROUND OF THE INVENTION

1. Field of the Invention

The present invention is generally directed to a relay drive for a polarized relay, and more particularly, to a relay drive having an armature movable in at least one working air gap provided between two pole faces of a split yoke, at least one permanent magnet and a coil permeated by parts of the yoke or a core connected directly therewith.

2. Description of the Prior Art

A wide variety of devices employ relays for remote switching and control, protection of electrical devices and systems, and in digital computers. Many types of relay drives are known. East German Patent No. 73,359 discloses a relay having a core surrounded by a coil and yoke parts attached to the end surfaces of the core thereby providing a working air gap. An unpolarized armature is mounted on a guide plate which abuts a pole area and on the other pole area a permanent magnet is placed. The armature extends beyond the pole area connected with the permanent magnet and abuts thereon in one of its two end positions so that the armature forms a magnetic short circuit in one of its two end positions.

The relay according to East German Patent No. 73,359, however, has a low sensitivity because in order to lift the armature from its position short-circuiting the permanent magnet, the coil must produce an appropriate magnetization.

Many types of relay structures are also known. European Patent No. A1-157 029 discloses a relay in which the yoke has two interconnected laterally pulled-up lugs and a reed that locks together between them. European Patent No. A2-130 423 discloses a relay having a yoke in the shape of an E with the coil placed on the central limb of the yoke. The relays according to European Patents A1-157-029 and A2-130 423 suffer from the disadvantage that the danger of armature chatter is always present due to the size and mass of the armature.

Polarized relays can be formed from neutral relays by bending a yoke part and the armature present in a neutral relay of an appropriate type and inserting another yoke part and a permanent magnet. This is of significance only in the production of the relay parts and the assembly thereof. The prior art construction in no way permits a change in the type of polarized relay, i.e. from a monostable relay to a bistable relay.

SUMMARY OF THE INVENTION

Accordingly, it is a primary object of the present invention to permit a change of the type of polarized relay in a simplified manner by allowing a permanent magnet to be replaced by a soft-iron part and vice versa using detachable connectors such as screws or snap locks. This can be effected during production and assembly of the relay parts or equally feasible at any later stage.

Another object of the present invention is to provide a relay with high sensitivity and simple construction.

Another object of the present invention is to reduce the danger of armature chatter by reducing the size and mass of the armature.

Further objects and advantages will be apparent from the following description and the accompanying drawings.

In carrying out the invention, there is formed at least one pole face cooperating with the armature or disposed thereon from one pole face of a permanent magnet and another pole face cooperating with the armature or disposed thereon formed by either another permanent magnet or a soft-iron part which are interchangeble and detachably connected.

Unlike the prior art discussed above, a short-circuit of the permanent magnet by the armature can be prevented with assurance resulting in a relay with high sensitivity. Also, each permanent magnet has only one residual air gap so that the efficiency of the permanent magnet is increased. Moreover, the design of the present invention includes a minimum of yoke parts leading to a low magnetic resistance and a corresponding increase in relay sensitivity. The design of the present invention also allows a permanent magnet to be replaced by a soft-iron part or vice versa using detachable connectors such as screws or snap locks thereby changing the type of polarized relay from monostable to bistable or vice versa.

BRIEF DESCRIPTION OF THE DRAWINGS

These and other advantages of the present invention may be appreciated from studying the following detailed description of the presently preferred exemplary embodiments together with the drawings in which.

DETAILED DESCRIPTION OF THE PREFERRED EMBODIMENTS

The preferred embodiments of the relay drive of the present invention will hereinafter be described in detail with reference to the accompanying drawings.

Figure 1:
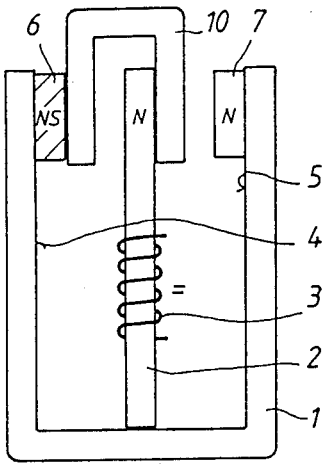
FIG. 1 is a diagram showing a monostable polarized relay according to a first embodiment of the present invention.
Figure 3:
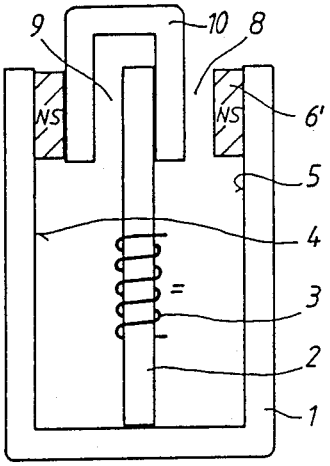
FIG. 3 is a diagram showing a bistable polarized relay according to a first embodiment of the present invention.
Figure 2:
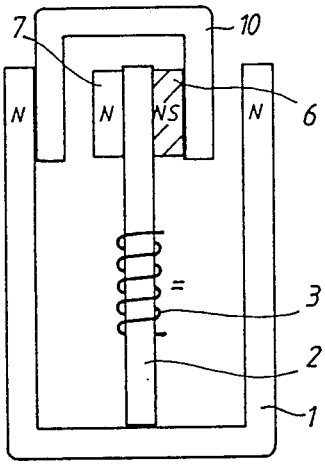
FIG. 2 is a variant of the embodiment depicted in FIG. 1.
Figure 4:
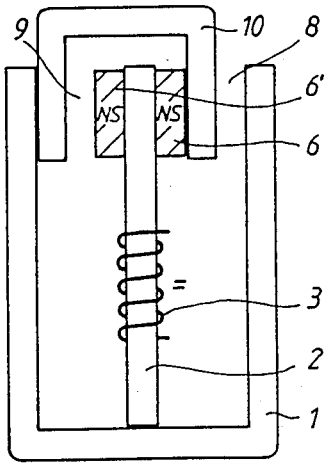
FIG. 4 is a variant of the embodiment depicted in FIG. 3.

FIGS. 1 and 3 are diagrams of a monostable and bistable polarized relay, respectively, according to a first embodiment of the present invention. FIGS. 2 and 4 are variations of the relays depicted in FIGS. 1 and 3 respectively. In FIGS. 1–4 the relay incorporates an E-shaped yoke 1 with a central limb 2 on which a coil 3, which is pulsed with DC signals, is disposed. On the outer limbs of yoke 1 are disposed pole faces 4 and 5 which face each other.

Unpolarized armature 10 has a U-shape and engages each of its two limbs in a working air gap. One of the working air gaps is delimited by one pole face of permanent magnet 6 and the other working air gap is delimited by either one pole face of another permanent magnet 6′ or of soft-iron part 7. The magnets 6 or 6′ and the soft-iron part 7 act as flux guides to direct magnetic flux across and air gap.

FIG. 1 shows a monostable polarized relay with permanent magnet 6 attached to pole face 4 and a soft-iron part 7 detachably connected to pole face 5. FIG. 3 shows said soft-iron part 7 replaced by another permanent magnet 6′ to form a bistable polarized relay. The soft-iron part 7 can be replaced by a permanent magnet 6′ and vice versa by use of detachable connectors such as screws or snaplocks. In FIG. 3 permanent magnets 6 and 6′ connected with their pole faces of opposite sign by yoke 1 so that permanent magnets 6 and 6′ are connected in series and their pole faces of opposite sign each delimit an air gap 8 and 9 in which the unpolarized armature 10 engages with its limbs.

FIGS. 2 and 4 differ from FIGS. 1 and 3 respectively in that permanent magnet 6 and either permanent magnet 6′ or soft-iron part 7 are mounted on central limb 2 of yoke 1. FIG. 4 shows permanent magnets 6 and 6′ abutting central limb 2 with their pole faces of opposite sign.

This results in very advantageous magnetic conditions by permitting construction of a very flat relay with an armature having a very small and light construction so that the danger of armature chatter can be largely avoided.

Figure 5:
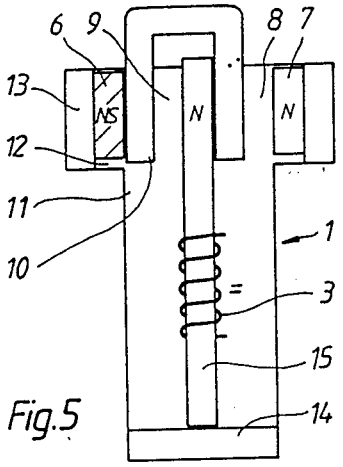
FIG. 5 is a diagram showing a monostable polarized relay according to a second embodiment of the present invention.
Figure 7:
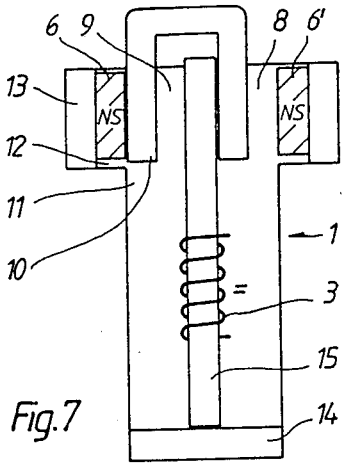
FIG. 7 is a diagram showing a bistable polarized relay according to a second embodiment of the present invention.
Figure 6:
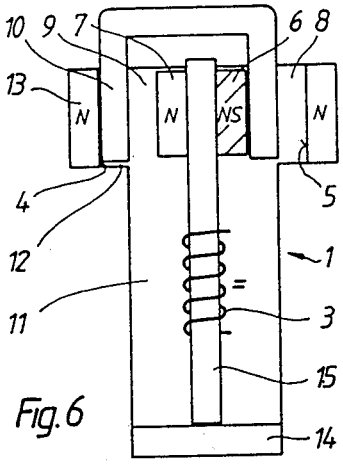
FIG. 6 is a variant of the embodiment depicted in FIG. 5.
Figure 8:
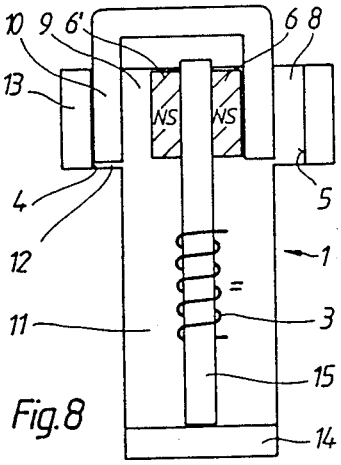
FIG. 8 is a variant of the embodiment depicted in FIG. 7.

FIGS. 5 and 7 are diagrams showing a monostable and a bistable polarized relay respectively according to a second embodiment of the present invention. FIGS. 6 and 8 are variations of the relays depicted in FIGS. 5 and 7 respectfully. The relay incorporates an L-shaped yoke 1 wherein one limb 11 of yoke 1 has in the area of its free end overhang 12 which ends in pulled-up lugs 13. Pole faces 4 and 5 of lugs 13 are turned towards each other and face each other.

Second limb 14 of L-shaped yoke 1 holds reed 15 on which is disposed coil 3. Reed 15 projects into the air gap delimited by either the pole faces of permanent magnet 6 and soft-iron part 7 or permanent magnets 6 and 6′ or by the pole faces 4 and 5 of pulled-up lugs 13. Reed 15 divides said air gap into air gaps 8 and 9.

FIG. 5 shows the pole faces 4 and 5 of lugs 13 with one permanent magnet 6 and a soft-iron part 7 to form a monostable polarized relay. FIG. 7 shows the soft-iron part 7 replaced by another permanent magnet 6′. As discussed above, soft-iron part 7 and permanent magnet 6′ are detachably connected and interchangeable.

FIGS. 6 and 8 are variants of FIGS. 5 and 7 respectively in which permanent magnet 6 and soft-iron part 7 or permanent magnets 6 and 6′ are mounted on reed 15.

The relay drive thus has a very narrow construction with an armature having very small dimensions and thus small masses, so that the danger of armature chatter is largely avoided. The permanent magnets can thus be mounted in such a way that they are connected by a very low magnetic resistance.

Figure 9:
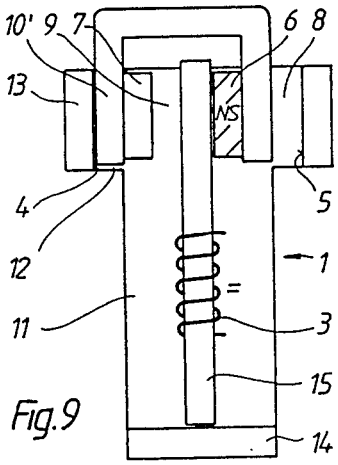
FIG. 9 is a diagram showing a monostable polarized relay according to a third embodiment of the present invention.
Figure 10:
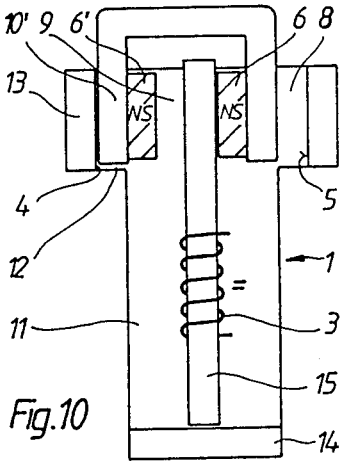
FIG. 10 is a diagram showing a bistable polarized relay according to a third embodiment of the present invention.

FIGS. 9 and 10 are variants of FIGS. 5 and 7 respectfully and show permanent magnet 6 and soft-iron part 7 in one case and permanent magnets 6 and 6′ in the other disposed on the limbs of armature 10′ facing each other that engage in working air gaps 8 and 9. In FIG. 10, the permanent magnets 6 and 6′ are connected together with their pole faces of opposite sign by the soft-iron bridge of the armature, resulting in a series connection of permanent magnets 6 and 6′.

Figure 13:
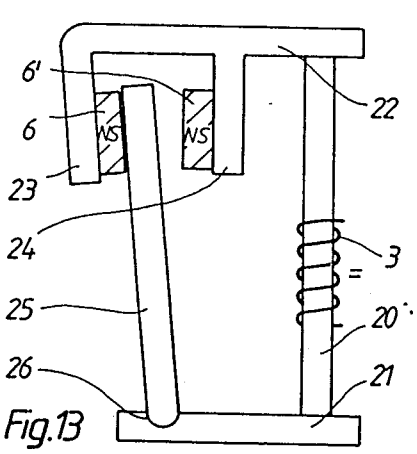
FIG. 13 is a diagram showing a bistable polarized relay according to a fourth embodiment of the present invention.
Figure 12:
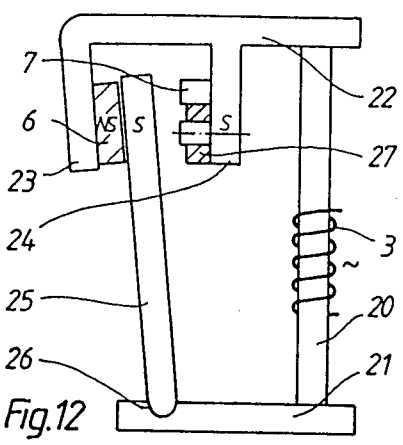
FIG. 12 is a variant of the embodiment depicted in FIG. 11.
Figure 11:
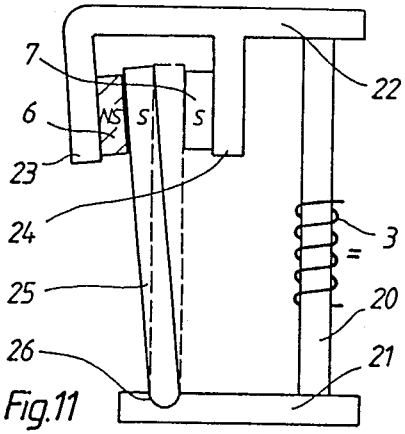
FIG. 11 is a diagram showing a monostable polarized relay according to a fourth embodiment of the present invention.

FIGS. 11 and 13 are diagrams showing a monostable and a bistable polarized relay respectively according to a fourth embodiment of the present invention. FIG. 12 is a variation of FIG. 11. The relay incorporates a F-shaped yoke 22. Armature 25 is hinged and mounted at one end in groove 26 of guide plate 21. Guide plate 21 is connected to yoke 22 by core 20. Core 20 has disposed thereon coil 3. Limbs 23 and 24 of yoke 22 delimit an air gap in which armature 25 engages with its free end. Permanent magnet 6 and soft-iron part 7 in FIGS. 11 and 12 and permanent magnets 6 and 6′ in FIG. 13 are placed on limbs 23 and 24 respectfully of yoke 22 so that permanent magnet 6 and soft-iron part 7 or permanent magnets 6 and are turned towards each other and face each other to form pole faces for armature 25. FIG. 12 provides a short-circuiting ring 27 on soft-iron part 7 so that the relay of the present invention can also be operated with alternating current. FIG. 13 which shows the permanent magnets 6 and 6′ connected to limbs 23 and 24 of yoke 22 results in a series connection of permanent magnets 6 and 6′.

Figure 16:
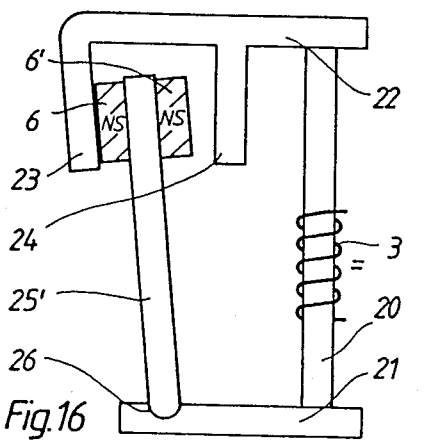
FIG. 16 is a diagram showing a bistable polarized relay according to a fifth embodiment of the present invention.
Figure 15:
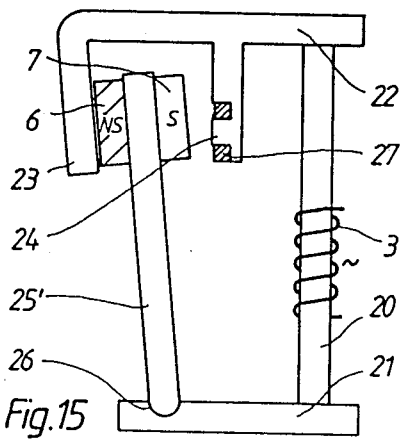
FIG. 15 is a variant of the embodiment depicted in FIG. 14.
Figure 14:
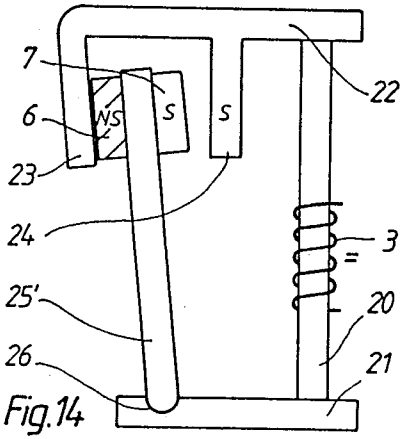
FIG. 14 is a diagram showing a monostable polarized relay according to a fifth embodiment of the present invention.

FIGS. 14 and 16 are diagrams showing a monostable and bistable polarized relay according to a fifth embodiment of the present invention. FIG. 15 is a variant of the relay depicted in FIG. 14. The relay employs the same F-shaped yoke 22 as in FIGS. 11–13. Instead of mounting the permanent magnet(s) and/or soft-iron part on the limbs 23 and 24 of yoke 25, permanent magnet 6 and soft-iron part 7 in one case and permanent magnets 6 and 6′ in the other are placed on armature 25′. FIG. 15 shows short-circuiting ring 27 disposed on pole face of limb 24 of yoke 22. Since the relay shown in FIGS. 11–16 has only one residual air gap, a very high trigger sensitivity is achieved.

While this invention has been shown and described in connection with several particular preferred embodiments, it is apparent that various changes and modifications, in addition to those mentioned above, may be made by those who are skilled in the art without departing from the basic features of the invention. Accordingly, it is the intention of the Applicant to protect all variations and modifications within the true spirit and valid scope of the invention.

What is claimed:

1. A relay drive for a polarized relay, comprising:

a split yoke having a plurality of limbs;

an armature moveably disposed between said limbs of said yoke;

coil means for inducing a magnetic field within said yoke;

a first flux guide magnetically coupled to said yoke and comprising a permanent magnet, one pole face of said permanent magnet defining a first pole face; and a second flux guide, detachably mounted within said relay, magnetically coupled to said yoke and directly defining a second pole face;

said first and second pole faces at least partially defining at least one air gap, said air gap permitting movement of said armature between said limbs of said yoke.

2. The relay drive according to claim 1, wherein said armature has the shape of a U, each of its two limbs being disposed in said air gap.

3. The relay drive according to claim 2, wherein said first flux guide and said second flux guide are connected in series.

4. The relay drive according to claim 2, wherein said yoke has two interconnected laterally pulled-up lugs and a reed that locks together between them, said pulled-up lugs housing said first flux guide and said second flux guide so that said flux guides are turned towards each other.

5. The relay drive according to claim 2, wherein said yoke has the shape of an E and said coil is placed on said yoke's central limb, said first flux guide and said second flux guide being disposed on areas of said yoke's outer limbs and are turned towards each other.

6. The relay drive according to claim 2, wherein said first flux guide and said second flux guide are disposed on said armature limbs which are disposed in said air gap, said armature forming a soft-iron bridge.

7. The relay drive according to claim 6, wherein said first flux guide and said second flux guide are connected in series.

8. The relay drive according to claim 1, wherein said armature is pivotally mounted on a portion of said yoke and has a free end disposed in said air gap, said first flux guide and said second flux guide being disposed on pole areas of said yoke and are turned towards each other.

9. The relay drive according to claim 8, wherein said yoke has the shape of a F, said second flux guide comprises a soft-iron part and said soft-iron part is provided with a short-circuiting ring.

10. The relay drive according to claim 1, wherein said armature is pivotally mounted on a portion of said yoke and has a free end disposed in said air gap, said first flux guide and said second flux guide being disposed on said armature's free end.

11. The relay drive according to claim 10, wherein said first flux guide and said second flux guide are connected in series.

12. The relay drive according to claim 10, wherein said yoke has the shape of a F, said second flux guide comprises a soft-iron part and said soft-iron part is provided with a short-circuiting ring.

13. The relay drive according to claim 1, wherein said second flux guide comprises a soft-iron part detachably mounted within said relay, thereby forming a monostable relay.

14. The relay drive according to claim 1, wherein said second flux guide comprises a permanent magnet detachably mounted within said relay, thereby forming a bistable relay.

* * * * *